United States Patent [19]

Thompson

[11] 3,961,796

[45] June 8, 1976

[54] GOLFING IRON HEAD WITH DOWNWARDLY TAPERED KEEL

[76] Inventor: Stanley C. Thompson, 7851 Talbert St. Apt. 1, Playa Del Rey, Calif. 90271

[22] Filed: Sept. 27, 1974

[21] Appl. No.: 510,111

Related U.S. Application Data

[63] Continuation-in-part of Ser. No. 368,641, June 11, 1973, Pat. No. 3,845,960.

[52] U.S. Cl. ..... 273/167 A; 273/167 F; 273/171

[51] Int. Cl.[2] ..... A63B 53/04

[58] Field of Search ..... 273/63 E, 77 A, 80 A, 273/81 A, 167–175

[56] References Cited

UNITED STATES PATENTS

| | | | |
|---|---|---|---|
| 645,944 | 3/1900 | Dalgleish | 273/169 |
| 1,453,503 | 5/1923 | Holmes | 273/171 |
| 1,622,864 | 3/1927 | Findlay | 273/169 |
| 1,983,196 | 12/1934 | Spiker | 273/171 X |
| 2,332,342 | 10/1943 | Reach | 273/171 |
| 2,846,228 | 8/1958 | Reach | 273/169 |
| 2,998,254 | 8/1961 | Rains et al. | 273/171 |
| 3,214,169 | 10/1965 | Rupnow | 273/171 X |
| 3,606,327 | 9/1971 | Gorman | 273/171 X |
| 3,625,518 | 12/1971 | Solheim | 273/167 A X |
| 3,655,188 | 4/1972 | Solheim | 273/169 X |
| 3,761,095 | 9/1973 | Thompson | 273/167 A X |

FOREIGN PATENTS OR APPLICATIONS

| | | | |
|---|---|---|---|
| 692,197 | 8/1964 | Canada | 273/169 |
| 194,823 | 3/1923 | United Kingdom | 273/171 |
| 5,368 | 3/1894 | United Kingdom | 273/171 |
| 347,502 | 4/1931 | United Kingdom | 273/171 |

*Primary Examiner*—Richard J. Apley
*Attorney, Agent, or Firm*—William W. Haefliger

[57] ABSTRACT

A golfing iron comprises:

a. a metallic head having a heel, a toe, and an upwardly and rearwardly inclined front face, b. said front face having lower edge portions which taper downwardly and toward one another from said toe and heel, respectively, thereby to define an apex generally below the center of the ball striking zone of the front face, said apex portion being downwardly convexly rounded, c. said head having an underside between said toe and heel, said underside defining a keel extending from said apex portion as a rearwardly elongated extension thereof, the keel being downwardly convexly rounded, and d. said underside having faces at opposite sides of the keel and which have downward concavity.

8 Claims, 5 Drawing Figures

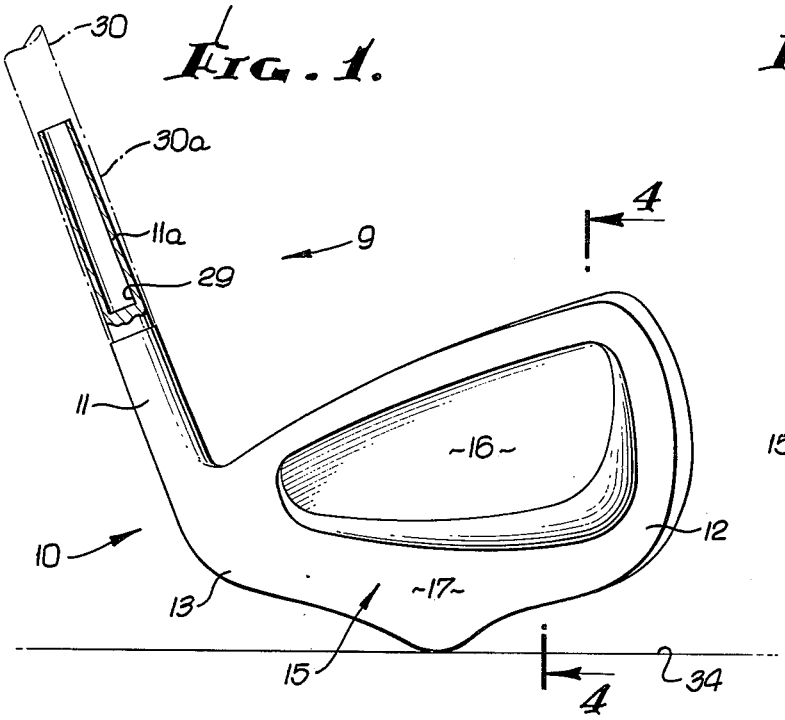
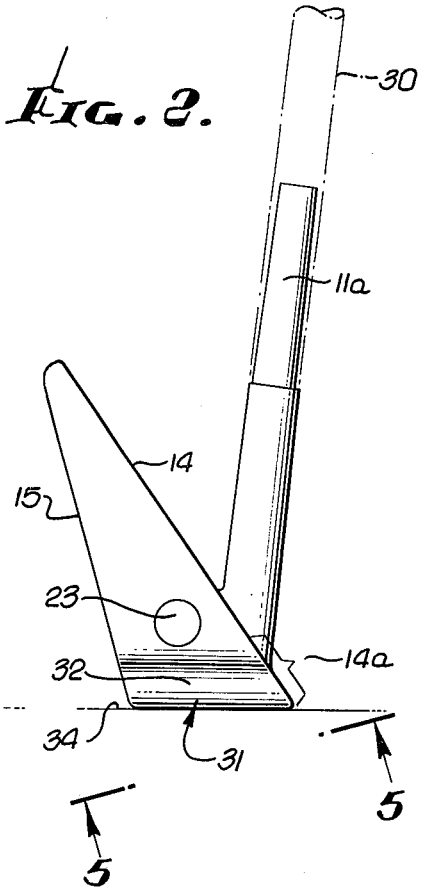
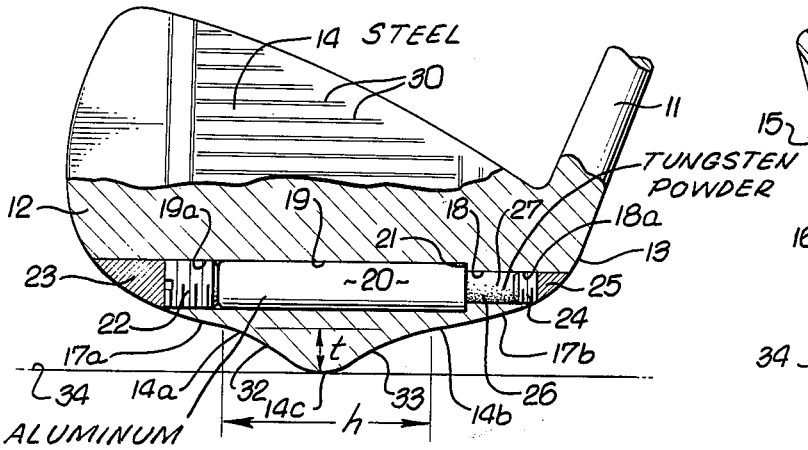
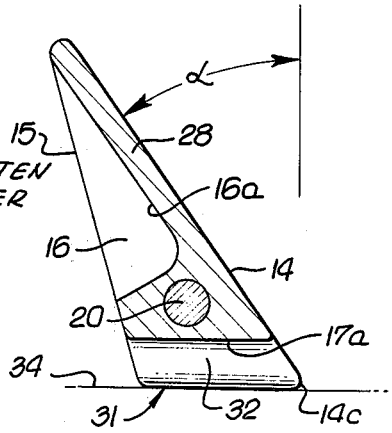
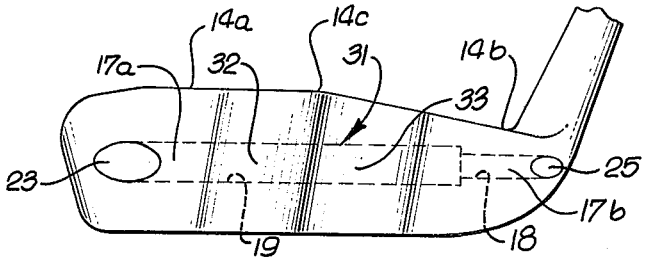
FIG. 5.

GOLFING IRON HEAD WITH DOWNWARDLY TAPERED KEEL

This application is a continuation-in-part of my prior application Ser. No. 386,641, filed June 11, 1973 and now U.S. Pat. No. 3,845,960.

BACKGROUND OF THE INVENTION

This invention relates generally to golf clubs, and more particularly concerns improvements in irons for use in the rough where grassy conditions normally interfere with desired engagement of the ball with the iron.

It is known that the ball striking face of an iron should engage the ball in such manner that controlled backspin is imparted to the golf ball. This function is impaired when the ball lies in the rough, for the grass will tend to come between the ball and the grooved striking face of the iron head in such manner that it will interfere with frictional contact and will prevent development of proper ball backspin. No way was known, prior to the present invention, to solve this problem in the manner affording unusual advantages in construction, mode of operation and results as described herein.

SUMMARY OF THE INVENTION

As will be seen, the invention is embodied in a balanced iron so constructed as to part or deflect the grass when swung, so that the ball will clearly engage the striking face of the head even in the rough. Basically the iron comprises:

a. a metallic head having a heel, a toe and an upwardly and rearwardly inclined front face, b. said front face having lower edge portions which taper downwardly and toward one another from said toe and heel, respectively, thereby to define an apex generally below the center of the ball striking zone of the front face, said apex portion being downwardly convexly rounded, c. said head having an underside between said toe and heel, said underside defining a keel extending from said apex portion as a rearwardly elongated extension thereof, the keel being downwardly convexly rounded, and d. said underside having faces at opposite sides of the keel and which have downward concavity.

Further, the underside faces may typically extend forwardly toward the front face and merge at rounded edges with the downwardly tapering lower edge portions; the apex may be centrally located generally below generally horizontal grooves in the front face, the latter typically having angularity from vertical of between about 30 and 40 degrees as in a wedge; and the iron may contain a weight receiving passage or passages between the keel and a hollow in rear side of the head, as will appear.

These and other objects and advantages of the invention, as well as the details of an illustrative embodiment, will be more fully understood from the following description and drawings, in which:

DRAWING DESCRIPTION

FIG. 1 is a rear side elevation of the head of a golfing iron embodying the invention;

FIG. 2 is a toe end elevation of the FIG. 1 head;

FIG. 3 is a front side elevation of the FIG. 1 head, the lower portion of which is cut away to show interior structure;

FIG. 4 is a section taken on lines 4-4 of FIG. 1; and

FIG. 5 is a view taken on lines 5-5 of FIG. 2.

DETAILED DESCRIPTION

Referring first to FIGS. 1-5 the metallic head 10 of an upright golf club iron 9 includes a hosel 11, toe 12 and heel 13, a front face 14 to strike a golf ball, a rear side 15 recessed at 16, and a base portion 17. Front face 14 has an inclination $\alpha$ from a vertical plane which may vary as required for the intended use of the iron; in this regard, the illustrated iron is intended to represent an iron known as a wedge for which $\alpha$ is between about 30 and 40 degrees from vertical, in FIG. 4.

An elongated through opening typically extends generally longitudinally within the base portion 17 between the heel and toe, that opening defined by a relatively short bore 18 proximate the heel and a relatively long counterbore 19. The latter may typically extend between the bore 18 and the toe 12, as best seen in FIG. 3. An elongated plug 20 extends within the counterbore 19 to provide balancing, i.e. "coarse" equalization of weight. Plug 20 is held in place abutting the counterbore shoulder 21 by a short retainer plug 22 having threaded connection with a tapped section 19a of the counterbore, and a suitable hardenable fill material 23 fills the counterbore space between plug 22 and the curvature at which the toe 12 merges with the base underside or lower face at 17*a*. Material 23 may consist of metal powder in a hardenable carrier resin such as an epoxide, or an equivalent substance. Plug 20 may be of a material (as for example aluminum) substantially less dense than the steel metal of the club head.

A relatively short plug 24 is threaded into a tapped section 18*a* of the bore 18, and sealed in position by hardenable fill material 25 (of a composition similar to that of material 23, for example). That fills the bore 18*a* between plug 24 and the curvature at which the heel 13 merges with the base underside or lower face at 17*b*. The space 26 formed in the bore 18 between plugs 20 and 24 is of a predetermined size, and is adapted to receive an amount of heavy metal powder 27 (as for example tungsten) for "fine" weight balancing purposes, as will appear. A precise amount of such powder, as determined by balancing the club after completion of fabrication, is inserted into space 26 prior to insertion of the plug 24 and fill material 23. Space 26 is of a length substantially less than the length of plug 20, and has a volume such that it is normally only partly filled with sufficient weighting material 27 needed for balancing. Accordingly, the coarse and fine balancing means 20 and 27 also serve to lighten the weight of the club head as well as to enable accurate and rapid balancing as required to "match" a set of irons. Note that the recess 16, which contributes to the light weight characteristics of the head, is directly above the base portion 17 that contains the plug 20. The inner wall 16*a* of the recess and the front face 14 define therebetween a relatively thin plate 28 which receives the direct impact developed when the head strikes the golf ball.

Hosel 11 includes an elongated stem 11*a* which contains an elongated bore 29, the latter also contributing to reduction of head weight. The stem is attached to the club shaft 30 as by a telescopic interfit of the shaft end over the stem, at 30*a* in FIG. 1.

The front face 14 has lower edge portions 14*a* and 14*b* which taper downwardly and toward one another from the toe and heel, respectively, thereby to define an apex portion 14*c*. The latter is generally below the center of the ball striking zone (as delineated by the horizontal grooves 30 in the front face), the apex portion being downwardly convexly rounded.

The head underside between the toe and heel also defines a keel 31 extending from the apex portion as a rearwardly elongated extension thereof, the keel being downwardly rounded or convex. Further, the underside of the base 17 has faces 32 and 33 at opposite sides of the keel and which have downward concavity. Note that the extent *h* of the keel, of height *t* is approximately centered below the balancing plug 20, in FIG. 3, in a direction looking rearwardly toward the front face of the club, with the keel resting flatly on horizontal surface 34.

In addition, the faces 32 and 33 extend forwardly toward the front face and merge at rounded edges with the downwardly tapering edge lower portions of the front face. As a result, the grass is parted by the keel away from the front face grooving 30, the balance weighting of the club is centered with respect to the keel, and located closely above the keel, and the balancing (less dense material of plug 20 as compared with the steel of the head) compensates for the additional weight of the steel keel, so that the club does not "feel" or swing differently, in the estimation of the golfer, from a club lacking such a steel keel.

I claim:

1. In a golf iron, a. a metallic club head having a toe and heel, a front face to strike a golf ball, a rear side, the head having an elongated base portion extending between the toe and heel, b. there being an elongated through opening extending within the base portion between the heel and the toe, c. an elongated balancing weight extending within the opening, and d. the base portion having an underside forming a downwardly convex keel extending rearwardly from the front face toward said rear side beneath said weight, e. said front face having lower edge portions which taper downwardly and toward one another from said toe and heel, respectively, thereby to define an apex generally below the center of the ball striking zone of the front face, said apex portion being downwardly convexly rounded, said keel extending from said apex portion as a rearwardly elongated extention thereof, said underside having faces at opposite sides of the keel and which have downward concavity, said faces extending beneath said opening, f. said through opening located approximately midway between said front face and said rear side of the head, and said through opening extending crosswise over that portion of the keel which is approximately midway between the forwardmost and rearwardmost extents of the keel, said through opening intersecting a convex outer surface of the heel which merges with one concave underside face, and also intersecting a convex outer surface of the toe which merges with the other concave underside face, g. the keel extending under the mid-portion of the weight, and including means to retain the weight in position within the opening and relative to the keel, h. and said balancing weight consisting of a material less dense than the material of said club head.

2. The iron of claim 1 including additional weighting material in said opening in the form of heavy metal powder.

3. The golf iron of claim 1 wherein the head rear side is inwardly recessed directly above said base portion containing said through opening.

4. The iron of claim 1 wherein said underside faces extend forwardly toward the front face and merge at rounded edges with said downwardly tapering lower edge portions.

5. The iron of claim 1 wherein said front face has generally vertically spaced parallel grooves extending generally laterally between said toe and heel, said apex located generally below the medial portion of said grooves.

6. The iron of claim 1 wherein said front face has angularity from vertical of between about 30° and 40° when said underside faces extend rearwardly horizontally.

7. In a golf iron, a. a metallic club head having a toe and heel, a front face to strike a golf ball, a rear side, the head having an elongated base portion extending between the toe and heel, b. there being an elongated through opening extending within the base portion between the heel and the toe, c. an elongated balancing weight extending within the opening, and d. the base portion having an underside forming a downwardly convex keel extending rearwardly from the front face toward said rear side beneath said weight, e. said front face having lower edge portions which taper downwardly and toward one another from said toe and heel, respectively, thereby to define an apex generally below the center of the ball striking zone of the front face, said apex portion being downwardly convexly rounded, said keel extending from said apex portion as a rearwardly elongated extention thereof, said underside having faces at opposite sides of the keel and which have downward concavity, said faces extending beneath said opening, f. said through opening located approximately midway between said front face and said rear side of the head, and said through opening extending crosswise over that portion of the keel which is approximately midway between the forwardmost and rearwardmost extents of the keel, g. the keel extending under the mid-portion of the weight, and including means to retain the weight in position within the opening and relative to the keel, h. there being additional weighting material in said opening in the form of heavy metal powder, said balancing weight consisting of a metal substantially less dense than the head metal, i. said opening being defined by a bore receiving a short plug at the heel end of the head, and a counterbore receiving the elongated weight.

8. The golf iron of claim 7 where said retaining means includes a retainer plug in the counterbore retaining the elongated plug in end-to-end relation with a counterbore shoulder formed between the bore and counterbore.

* * * * *